US007291966B2

(12) United States Patent
Kaneko et al.

(10) Patent No.: US 7,291,966 B2
(45) Date of Patent: Nov. 6, 2007

(54) DISPLAY DEVICE

(75) Inventors: Yoshiyuki Kaneko, Hachioji (JP); Masakazu Sagawa, Inagi (JP); Toshiaki Kusunoki, Tokorozawa (JP); Tomoki Nakamura, Chiba (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 255 days.

(21) Appl. No.: 11/204,348

(22) Filed: Aug. 16, 2005

(65) Prior Publication Data

US 2006/0038472 A1 Feb. 23, 2006

(30) Foreign Application Priority Data

Aug. 18, 2004 (JP) ..... 2004-238258

(51) Int. Cl.
*H01J 1/62* (2006.01)

(52) U.S. Cl. ..... 313/496; 313/495

(58) Field of Classification Search ..... 313/495–497
See application file for complete search history.

(56) References Cited

U.S. PATENT DOCUMENTS 5,576,596 A 11/1996 Curtin et al.
5,734,224 A 3/1998 Tagawa et al.
5,742,117 A 4/1998 Spindt et al.
6,225,737 B1 5/2001 Pong et al.
6,489,718 B1 12/2002 Schmid et al.

FOREIGN PATENT DOCUMENTS

JP 3241219 10/2001

*Primary Examiner*—Vip Patel
(74) *Attorney, Agent, or Firm*—Antonelli, Terry, Stout & Kraus, LLP.

(57) ABSTRACT

The present invention prevents a phenomenon that some electrons emitted from electron sources are charged to partition walls from influencing trajectories of the electrons thus preventing the shortage of excitation of phosphor layers. An image display device includes electron sources to which an electric current is supplied from scanning signal lines by way of current supply electrodes. The image display device also includes partition walls which are arranged on at least some of the scanning signal lines. Further, the current supply electrodes are connected with the electron sources on a downstream side of the scanning signal lines.

7 Claims, 7 Drawing Sheets

DISPLAY DEVICE

BACKGROUND OF THE INVENTION

1. Field of the Invention

The present invention relates to a self-luminous flat-panel-type image display device, and more particularly to an image display device which arranges thin-film-type electron sources in a matrix array.

2. Description of the Related Art

As one self-luminous flat-panel-type image display (FPD) having electron sources which are arranged in a matrix array, a field emission type image display device (FED: Field Emission Display) which uses minute integrative cold cathodes and an electron emission type image display device have been known. As the cold cathode, there have been known a thin-film-type electron source such as a Spint-type electron source, a surface-conducive-type electron source, a carbon-nanotube-type electron source, an MIM (Metal-Insulator-Metal) type electron source which is formed by stacking a metal layer, an insulator and a metal layer in this order, or an MIS (metal-insulator-semiconductor) type electron source which is formed by stacking a metal layer, an insulator and a metal layer in this order or a metal-insulator-semiconductor-metal type electron source.

With respect to the MIM type electron emission element, for example, electron emission elements which are disclosed in Japanese Patent Laid-open Hei7(1995)-65710 (patent literature 1) and Japanese Patent Laid-open Hei10(1998)-153979 (patent literature 2) have been known. Further, as the metal-insulator-semiconductor-type electron sources, there have been known the MOS-type electron sources which are reported in J. Vac. Sci. Techonol. B11(2) p. 429-432 (1993) (non-patent literature 1). With respect to the metal-insulator-semiconductor-metal-type electron sources, there have been known HEED-type electron sources which are reported in "High-efficiency-electro-emission device, Jpn. J. Appl. Phys. Vol 36, pL 939" (non-patent literature 2), EL-type electron sources which are reported in "Electroluminescence, Applied Physics vol 63, No. 6, p. 592" (non-patent literature 3) or the like, porous-silicon-type electron sources which are reported in "Applied Physics vol 66, No. 5, p. 437" (non-patent literature 4)

The self-luminous-type FPD includes a display panel which is constituted of a back panel which is provided with the above-mentioned electron sources, a face panel which is provided with phosphor layers and an anode to which an accelerating voltage for allowing electrons emitted from an electron source to impinge on the phosphor layers is applied, and a sealing frame which seals an inner space defined between both facing panels into a given vacuum state. The back panel includes the above-mentioned electron sources formed on the back substrate, while the face panel includes the phosphor layers formed on a face substrate and the anode to which the accelerating voltage for forming an electric field which allows the electrons emitted from the electron sources to impinge on the phosphor layer is supplied. By combining driving circuits to the display panel, the self-luminous-type FPD is constituted.

Each electron source constitutes a unit pixel by forming a pair with the corresponding phosphor layer. Usually, one pixel (color pixel) is constituted of unit pixels of three colors consisting of red (R), green (G), blue (B). Here, in case of the color pixels, the unit pixel is also referred to as a sub pixel.

A distance between the back panel and the face panel is held at a given interval using members referred to as partition walls. The partition walls are formed of a plate-like body which is made of an insulating material such as glass, ceramics or a material having conductivity to some extent. Usually, the partition walls are mounted for every plurality of pixels at positions which do not obstruct the operation of the pixels.

SUMMARY OF THE INVENTION

The back panel has the back substrate made of an insulating material. On the back substrate, a plurality of scanning signal lines which extend in one direction and are arranged in another direction orthogonal to one direction are formed, wherein a scanning signal is sequentially applied to the scanning signal lines in another direction. Further, on the back substrate, a plurality of image signal lines which extend in another direction and are arranged in parallel in one direction so as to cross the scanning signal lines are formed. In the vicinities of the respective crossing portions of the scanning signal lines and the image signal lines, the above-mentioned electron sources are mounted, the scanning signal lines and the electron sources are connected with each other through current supply electrodes, and an electric current is supplied to the electron sources from the scanning signal lines.

With respect to the self-luminous-type FPD having the back panel in which the plurality of scanning signal lines which extend in one direction (lateral direction, horizontal direction) and are arranged in parallel in another direction (longitudinal direction, vertical direction) orthogonal to one direction are formed on the back substrate and, at the same time, the partition walls are mounted on the scanning signal lines in the extending direction of the scanning signal lines, when the vertical scanning signal line is sequentially applied to the scanning signal lines arranged in parallel in another direction, there may be a case that a phenomenon which is explained in conjunction with FIG. 9 and FIG. 10 occurs.

FIG. 9 is a schematic view showing the constitution of the back panel of the self-luminous-type FPD. On the back substrate not shown in the drawing, a plurality of image signal lines d1, d2, . . . dn extend in the y direction and are arranged in parallel in the x direction. Further, a plurality of scanning signal lines (vertical scanning lines) s1, s2, s3, . . . sm extend in the x direction and are arranged in parallel in the y direction in a state that the scanning signal lines cross the image signal lines. Electron sources ELS on one line are connected to the respective scanning signal lines s1, s2, s3, . . . sm, and an image signal from the image signal line is applied to the electron sources ELS which are connected to the scanning signal line which is selected by the sequential scanning in the vertical scanning direction VS. The scanning signal supplied to the respective scanning signal lines s1, s2, s3, . . . sm is supplied from a scanning signal line driving circuit (scanning driver) SDR, while the image signal supplied to the respective image signal lines d1, d2, . . . dn is supplied from an image signal line driving circuit (data driver) DDR.

On the scanning signal line, a partition wall SPC is mounted in the extending direction (X direction) in a state that the partition wall SPC is erected in the face panel direction, that is, in the z direction. Although the partition walls SPC may be mounted on all scanning signal lines, in an actual arrangement, the partition wall SPC is mounted for every plurality of scanning signal lines. Further, it is preferable to mount the partition wall SPC in a state that the partition wall SPC is divided into several walls along the scanning signal line rather than one single partition wall along the scanning signal line from a viewpoint of easiness of the manufacture. In FIG. 9, the partition wall SPC is shown in a state that the SPC is divided in two on the scanning signal line s2.

FIG. 10 is a schematic cross-sectional side view taken along the y direction in FIG. 9 and also is a view which explains a state in which the partition walls are mounted in an erected manner and the behavior of electrons emitted from the electron sources. Here, in FIG. 10, a face panel PNL2 is also shown together with a back panel PNL1. On an inner surface of the back panel PNL1, image signal lines d (d1, d2, . . . dn) are formed, and scanning signal lines s (s1, s2, s3, . . . sm) are formed on the image signal lines d (d1, d2, . . . dn) in an intersecting manner by way of an insulating film (not shown in the drawing). In FIG. 10, the partition wall SPC is formed on the scanning signal line s2, and the electron source ELS (ELS2) is mounted on an upstream side in the vertical scanning direction VS with respect to the partition wall SPC, wherein an electric current is supplied to the electron source ELS (ELS2) from the scanning signal line s2 via a connecting electrode ELC (ELC2).

An anode electrode (AD) is formed on an inner surface of the face panel PNL2, wherein the anode electrode AD accelerates electrons $e^-$ which are irradiated from the electron sources ELS (ELS1, ELS2, ELS3, . . . ) and allows the electrons $e^-$ to impinge on phosphor layers PH (PH1, PH2, PH3, . . . ) which constitute corresponding sub pixels. Accordingly, the phosphor layer PH (PH1, PH2, PH3, . . . ) emits light with a given color and the light is mixed with emitting lights having different colors emitted from the phosphors of other sub pixels thus constituting the color pixel of a given color.

In FIG. 10, the electron source ELS2 is electrically connected with the scanning signal line s2 and hence, the electron source ELS2 is arranged close to the scanning signal line s2 side (the right side of the electron source ELS2 in FIG. 10) than the scanning signal line s1 side (the left side of the electron source ELS2 in FIG. 10).

In such an arrangement of the partition walls, as viewed from the vertical scanning direction VS, some electrons $e^-$ irradiated from the electron source ELS2 arranged right in front of the partition wall SPC are charged to the partition wall SPC. This charging distorts trajectories of the electrons irradiated from the electron source ELS3 which is positioned downstream in the vertical scanning direction VS with respect to the partition wall SPC and hence, it is impossible to allow sufficient electrons to impinge on the phosphor layer whereby there may be a case that the excitation becomes insufficient. As a result, the shortage of brightness is generated and the color reproducibility is deteriorated. Although FIG. 10 shows the case in which the partition wall is negatively charged, it is needless to say that the same phenomenon occurs when the partition wall is positively charged.

It is an object of the present invention to provide an image display device which can enhance the color reproducibility by obviating the influence on electron trajectories attributed to a phenomenon that some electrons irradiated from electron sources are charged to partition walls thus preventing the shortage of brightness attributed to the shortage of excitation of phosphor layers.

To achieve the above-mentioned object, according to the present invention, in an image display device in which the image display device includes electron sources to which an electric current is supplied from scanning signal lines via current supply electrodes and, at the same time, includes partition walls which are mounted on and along the scanning signal lines, the electron sources to which the electric current is supplied from the scanning signal lines are arranged on a downstream side in the vertical scanning direction with respect to the partition walls.

The scanning signal line on which the partition wall is mounted is arranged close to the electron source side which is positioned immediately downstream with respect to the partition wall than the electron source side which is positioned immediately upstream with respect to the partition wall and hence, electrons which are irradiated from the electron source positioned downstream are liable to be easily charged to the partition wall.

When the electrons from the electron source positioned immediately downstream with respect to the partition wall is charged to the partition wall, the electron source whose electron trajectory receives the influence due to discharging receives the influence after 1 vertical scanning period (1 frame) period. Since this charging is gradually discharged during the 1 frame, the influence of the electrons irradiated from the electron source on the upstream closest to the partition wall on the trajectories of the electrons becomes extremely small whereby the image display device which can alleviate the shortage of brightness and can enhance the color reproducibility can be realized.

DESCRIPTION OF THE PREFERRED EMBODIMENTS

The present invention is explained in detail in conjunction with drawings which show several embodiments hereinafter.

Embodiment 1

Figure 1:
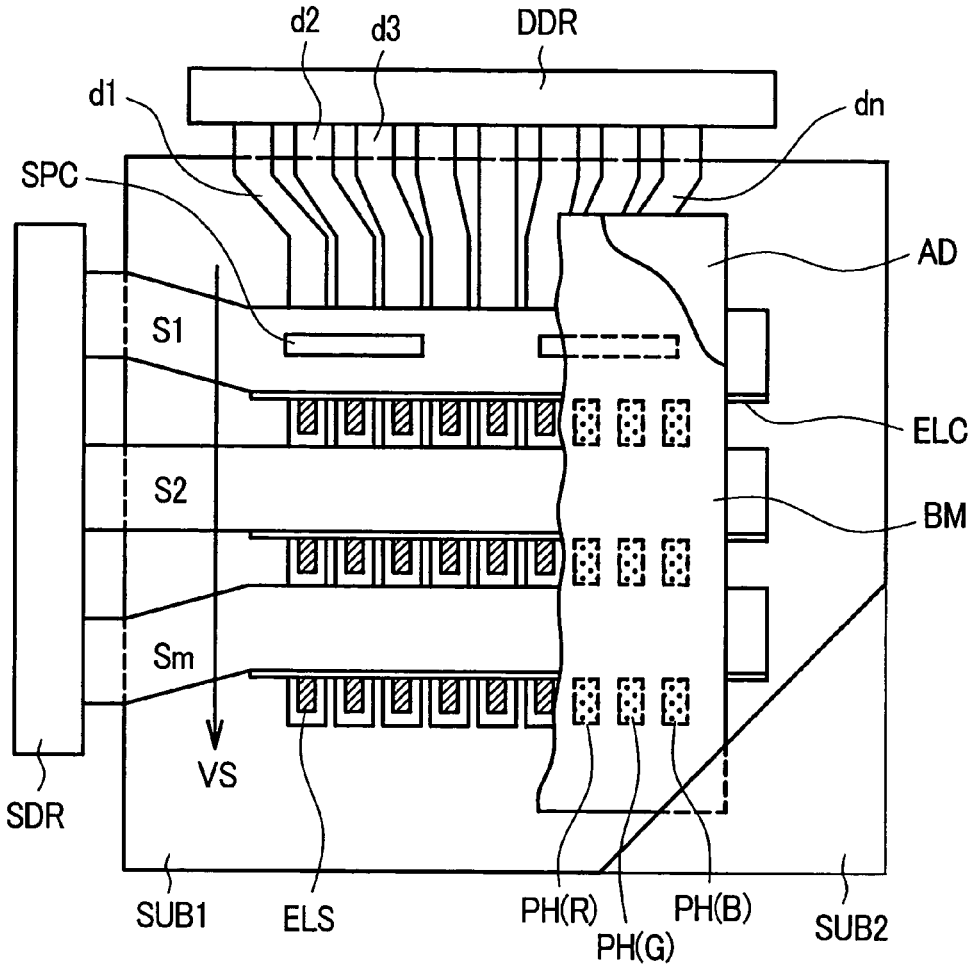
FIG. 1 is a schematic plan view for explaining the constitution of an image display device of an embodiment 1.

FIG. 1 is a schematic plan view for explaining the constitution of an image display device of an embodiment 1. On an inner surface of a back substrate SUB1 which constitutes a back panel, image signal lines d (d1, d2, d3, . . . dn) are formed, and scanning signal lines s (s1, s2, . . . sm) are formed above the image signal lines d (d1, d2, d3, . . . dn) in an intersecting manner by way of an insulation film (not shown in the drawing). In FIG. 1, a partition wall SPC is formed on the scanning signal line s1, an electron source ELS is formed on a downstream side in the vertical scanning direction VS with respect to the partition wall SPC, and an electric current is supplied to the electron source ELS from the scanning signal line s (s1, s2, . . . sm) via a connecting electrode ELC.

On an inner surface of a front substrate SUB2 which constitutes a face panel, an anode electrode AD is formed, and phosphor layers PH (PH(R), PH(G), PH(B)) are formed on the anode electrode AD. In this constitution, the phosphor layers PH (PH(R), PH(G), PH(B)) are defined by a light blocking layer (black matrix) BM. Here, although the anode electrode AD is shown as a matted electrode, the anode electrode AD may be formed of stripe-like electrodes which intersect the scanning signal lines s (s1, s2, . . . sm) and are divided for every pixel row. The anode electrode AD accelerates electrons irradiated from the electron sources ELS and allows the electrons to impinge on the phosphor layers PH (PH(R), PH(G), PH(B)) which constitute the corresponding sub pixels. Due to such a constitution, the phosphor layer PH emits light having a given color and the light is mixed with lights of different colors emitted from phosphors of other sub pixels thus forming a color pixel of a given color.

Figure 2:
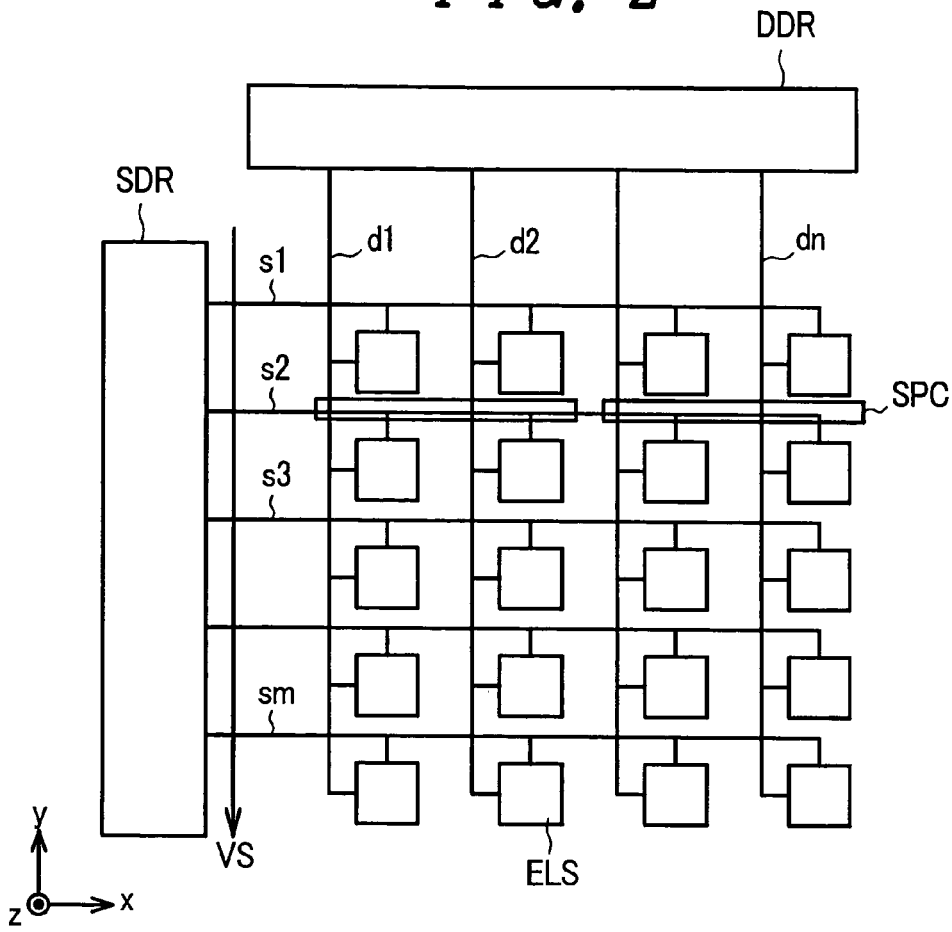
FIG. 2 is a schematic view showing the constitution of a back panel of a self-luminous-type FPD in the embodiment 1.

FIG. 2 is a schematic view showing the constitution of a back panel of the FED in the embodiment 1. The plurality of image signal lines d1, d2, . . . dn extend in the y direction and are arranged in parallel in the x direction on a back substrate not shown in the drawing. Further, the plurality of scanning signal lines (vertical scanning lines) s1, s2, s3 . . . sm extend in the x direction and are arranged in parallel in the y direction in a state that the scanning signal lines intersect the image signal lines. The electron sources ELS on one line are connected to each scanning signal line s1, s2, s3, . . . sm, and an image signal from the image signal line is applied to the electron sources ELS which are connected to the scanning signal line selected by the sequential scanning in the vertical scanning direction VS. The scanning signal to the respective scanning signal lines s1, s2, s3 . . . sm, is supplied from a scanning signal line driving circuit (scanning driver) SDR, while the image signal to the respective image signal lines d1, d2, . . . dn is supplied from an image signal line driving circuit (data driver) DDR.

On the scanning signal line s2, a partition wall SPC is mounted in the extending direction (x direction) in a state that the partition wall SPC is erected in the face panel direction, that is, in the z direction. Although the partition walls SPC may be mounted on all scanning signal lines, in an actual arrangement, the partition wall SPC is mounted for every plurality of scanning signal lines. Further, it is preferable to mount the partition wall SPC in a state that the partition wall SPC is divided into several walls along the scanning signal line rather than one single partition wall along the scanning signal line from a viewpoint of easiness of the manufacture. In FIG. 2, the partition wall SPC is shown in a state that the SPC is divided in two on the scanning signal line S2.

Figure 3:
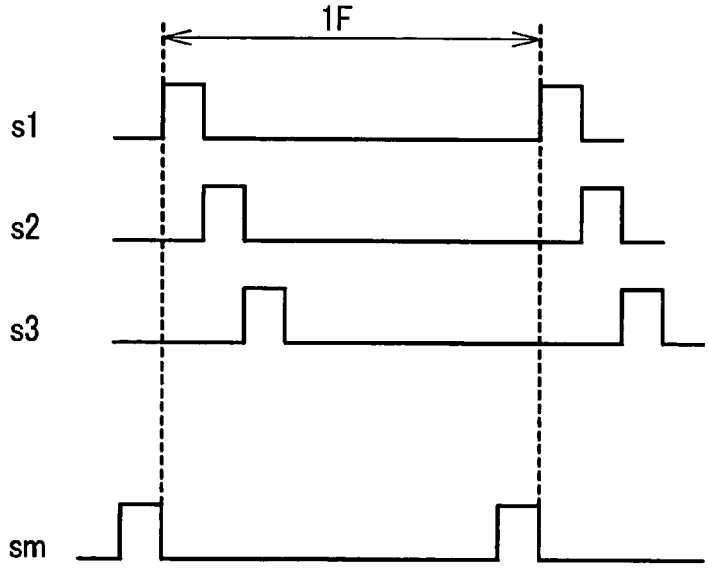
FIG. 3 is a view for explaining timing of a vertical scanning signal supplied to scanning signal lines.

FIG. 3 is a view for explaining the timing of a vertical scanning signal which is supplied to the scanning signal lines. The vertical scanning signal is sequentially supplied to the scanning signal lines s1, s2, s3, . . . sm in the scanning direction VS in FIG. 2 and circulates within one frame period.

Figure 4:
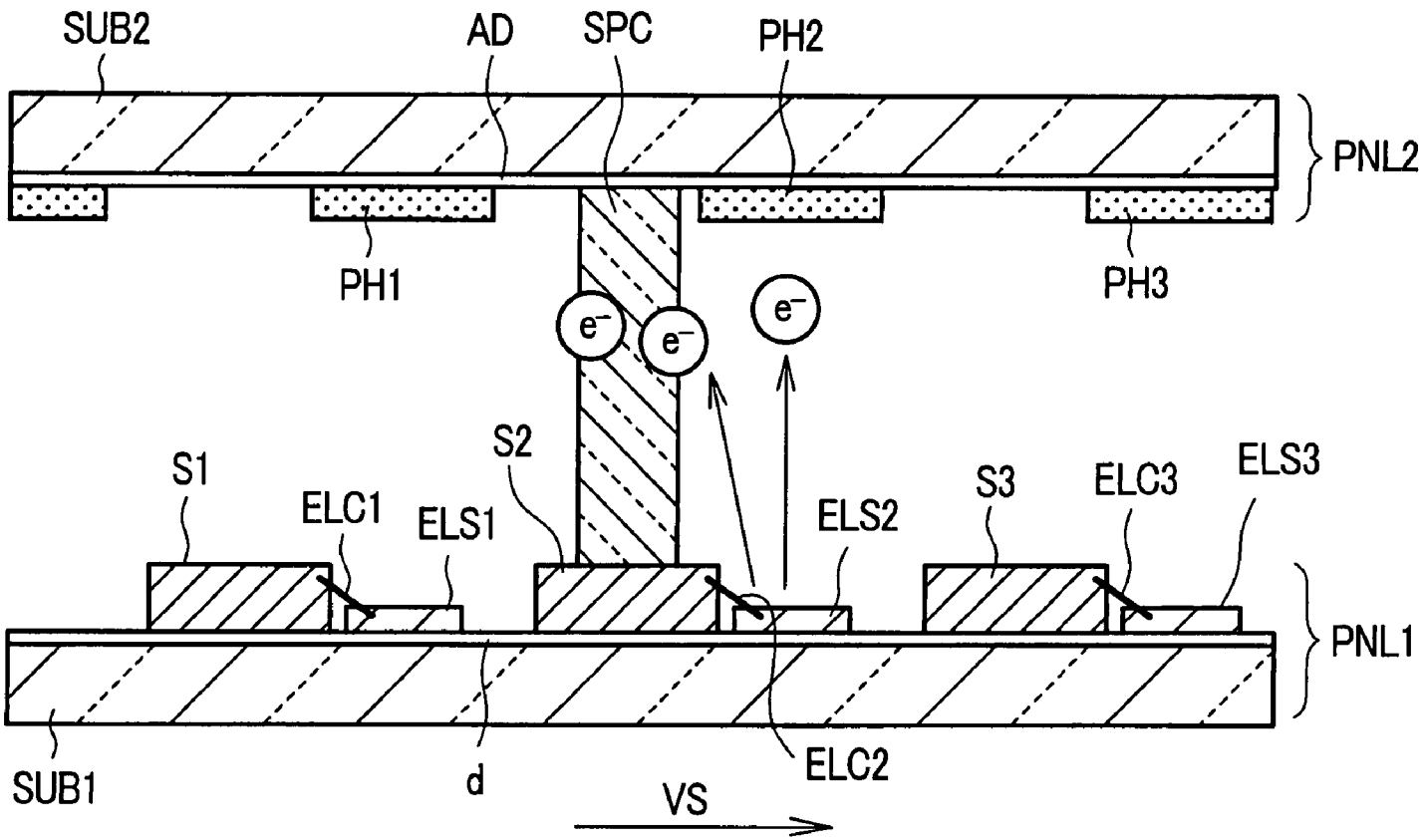
FIG. 4 is a view taken along the y direction in FIG. 2 for explaining an erected state of a partition wall and the behavior of electrons emitted from electron sources.

FIG. 4 is a schematic cross-sectional side view taken along the y direction in FIG. 2 and also is a view which explains a state in which the partition walls are mounted in an erected manner and the behavior of electrons emitted from the electron sources. Here, in FIG. 4, a face panel PNL2 is also shown together with a back panel PNL1. On an inner surface of the back panel PNL1, the image signal lines d (d1, d2, . . . dn) are formed, and the scanning signal lines s (s1, s2, s3, . . . sm) are formed on the image signal lines d (d1, d2, . . . dn) in an intersecting manner by way of an insulating film (not shown in the drawing). In FIG. 4, the partition wall SPC is formed on the scanning signal line s2, and the electron source ELS (ELS2) is mounted on a downstream side in the vertical scanning direction VS with respect to the partition wall SPC, wherein an electric current is supplied to the electron source ELS2 from the scanning signal line s2 via a connecting electrode ELC2.

An anode electrode AD is formed on an inner surface of the face panel PNL2, wherein the anode electrode AD accelerates electrons $e^-$ which are irradiated from the electron sources ELS (ELS1, ELS2, ELS3, . . . ) and allows the electrons $e^-$ to impinge on phosphor layers PH (PH1, PH2, PH3, . . . ) which constitute corresponding sub pixels. Accordingly, the phosphor layer PH (PH1, PH2, PH3, . . . ) emits light with a given color and the light is mixed with lights having different colors emitted from the phosphors of other sub pixels thus constituting the color pixel of a given color.

In FIG. 4, the electron source ELS2 is electrically connected with the scanning signal line s2 on the downstream side with respect to the partition wall SPC (the right side of the partition wall SPC in FIG. 4) as viewed in the vertical scanning direction VS. Then, the scanning signal line s2 on which the partition wall SPC is formed is arranged closer to the electron source ELS2 side which is positioned immediately downstream with respect to the partition wall SPC than the electron source ELS1 side which is positioned immediately upstream with respect to the partition wall SPC. Due to such positional relationship among the electron source, the scanning signal line and the partition wall, the electrons which are irradiated from the electron source ELS2 positioned downstream of the partition wall SPC are liable to be easily charged to the partition wall SPC.

In such an arrangement of the partition wall SPC, assume that some electrons $e^-$ irradiated from the electron source ELS2 arranged immediately behind the partition wall SPC as viewed in the vertical scanning direction VS are charged to the partition wall SPC. This charging may have the possibility of influencing the trajectories of the electrons irradiated from the electron source ELS1 which is positioned upstream in the vertical scanning direction VS with respect to the partition wall SPC. However, the electron source ELS1 which is positioned upstream is arranged closer to the scanning signal line s1 side (the left side of the electron source ELS1 in FIG. 4) than the scanning signal line s2 side (the right side of the electron source ELS1 in FIG. 4) and hence, the distance between the electron source ELS1 and the scanning signal line s2 has some margin. Further, since the electron source ELS1 is selected after 1 frame period and hence, a charge which is charged to the partition wall SPC is gradually discharged during 1 frame period whereby the influence of the charge on the trajectories of the electrons irradiated from the electron source ELS1 positioned upstream and closest to the partition wall SPC becomes extremely small thus realizing the image display device which can enhance color reproducibility by alleviating the shortage of brightness.

Figure 5:
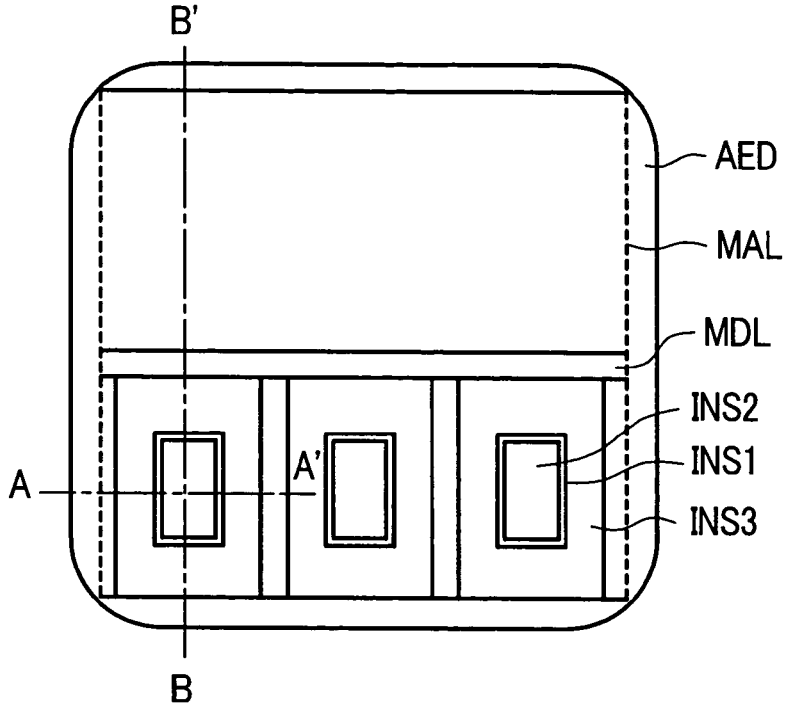
FIG. 5A, FIG. 5B and FIG. 5C are views for explaining one example of the electron source which constitutes one color pixel in the embodiment 1.
Figure 5:
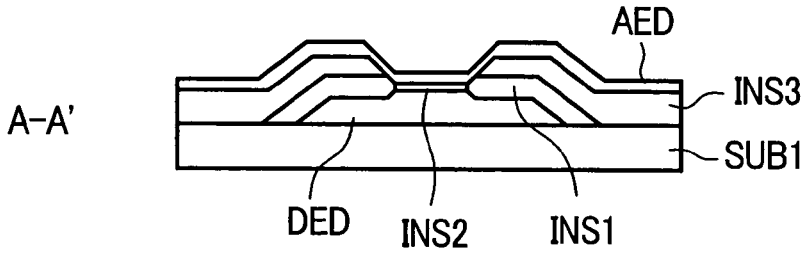
Figure 5:
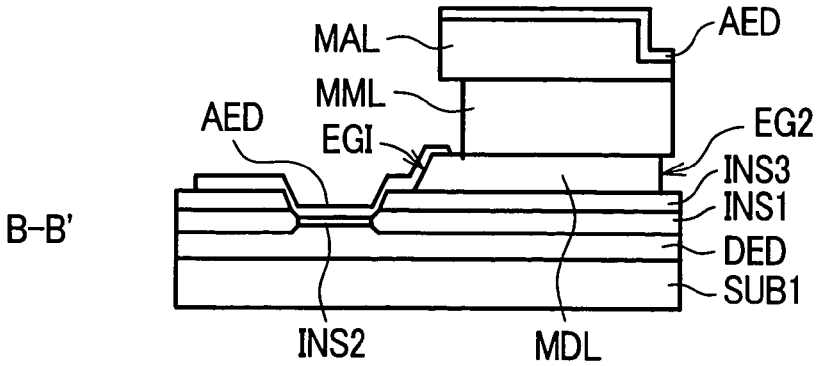

FIG. 5A to FIG. 5C are views for explaining one example of electron source which constitutes one color pixel in the embodiment 1, wherein FIG. 5A is a plan view, FIG. 5B is a cross-sectional view taken along a line A-A' in FIG. 5A, and FIG. 5C is a cross-sectional view taken along a line B-B' in FIG. 5A. Here, the electron source is formed of an MIM electron source.

The structure of the electron source is explained in conjunction with the manufacturing steps thereof. First of all, on the back substrate SUB1, a lower electrode DED, a protective insulating layer INS1 and an insulating layer INS2 are formed. Next, an interlayer film INS3 and metal films which form an upper bus electrode constituting a current supply line to an upper electrode AED and a spacer electrode for arranging a spacer are formed by a sputtering method or the like, for example. The interlayer film INS3 may be made of silicon oxide, silicon nitride or silicon, for example. Here, silicon nitride is used as the material of the interlayer film INS3 and a thickness of the interlayer film INS3 is set to 100 nm. The interlayer film INS3, when a pin hole is formed in the protective insulating layer INS1 which is formed by anodizing, embeds a cavity and plays a role of keeping the insulation between the lower electrode DED and the upper bus electrode (a three-layered stacked film which sandwiches copper (Cu) forming a metal-film intermediate layer MML between a metal-film lower layer MDL and a metal-film upper layer MAL) which constitutes the scanning signal line.

Here, the upper bus electrode which constitutes the scanning signal line is not limited to the above-mentioned three-layered stacked film and the number of layers can be increased more than three layers or decreased less than three layers. For example, as the metal-film lower layer MDL and the metal-film upper layer MAL, a film made of a metal material having high oxidation resistance such as aluminum (Al), chromium (Cr), tungsten (W), molybdenum (Mo) or the like, an alloy of these material or a stacked film made of these materials can be used. Here, in this embodiment, an aluminum-neodymium (Al—Nd) alloy is used as the metal-film lower layer MDL and the metal-film upper layer MAL. Besides these materials, with the use of a five-layered film which uses a stacked film formed of an Al alloy film and a Cr film, a W film, a Mo film and an Al alloy film as the metal-film lower layer MDL, a stacked film formed of a Cr film, a W film, a Mo film and an Al alloy film as the metal-film upper layer MAL and uses high-melting-point metal as a film which is brought into contact with Cu in the metal-film intermediate layer MML, during the heating step in the manufacturing process of the image display device, the high-melting-point metal forms a barrier film so that the alloying of Al and Cu can be suppressed and this suppression of alloying is particularly effective in reducing the resistance of the wiring.

When the Al—Nd alloy film is used as the upper bus electrode, with respect to a film thickness of the Al—Nd alloy film, a thickness of the metal-film upper layer MAL is set larger than a thickness of the metal-film lower layer MDL, while a thickness of the Cu film which constitutes the metal-film intermediate layer MML is increased as much as possible to reduce the wiring resistance. Here, the film thickness of the metal-film lower layer MDL is set to 300 nm, the film thickness of the metal-film intermediate layer MML is set to 4 μm, and the film thickness of the metal-film upper layer MAL is set to 450 nm. Here, the Cu film which constitutes the metal-film intermediate layer MML can be formed by electroplating besides sputtering.

In forming the above-mentioned five-layered film using the high-melting-point metal, in the same manner as the Cu film, it is particularly effective to use a stacked film which sandwiches the Cu film with Mo films which can be etched by wet etching using a mixed aqueous solution of phosphoric acid, acetic acid and nitric acid as the metal film intermediate layer MML. In this case, a film thickness of the Mo films which sandwich the Cu film is set to 50 nm, a film thickness of the AL alloy film which forms the metal-film lower layer MDL for sandwiching the metal-film intermediate layer is set to 300 nm, and a film thickness of the AL alloy film which forms the metal-film upper layer MAL for sandwiching the metal-film intermediate layer is set to 450 nm.

Subsequently, due to the patterning of resist by screen printing and etching, the metal-film upper layer MAL is formed in a stripe shape which intersects the lower electrodes DED. The etching is performed by wet etching using a mixed aqueous solution of phosphoric acid and acetic acid. Since the etchant does not contain nitric acid, for example, it is possible to selectively etch only the Al—Nd alloy film without etching the Cu film.

Also in forming the five-layered film using Mo, using the etchant which does not contain nitric acid, it is possible to selectively etch only the Al—Nd alloy film without etching the MO film and the Cu film. Here, although one metal-film upper layer MAL is formed per one pixel, it is also possible to form two metal-film upper layers MAL per one pixel.

Subsequently, using the same resist film as it is or using the Al—Nd alloy film on the metal-film upper layer MAL as a mask, the Cu film of the metal-film intermediate layer MML is etched by wet etching using a mixed aqueous solution of phosphoric acid, acetic acid and nitric acid. Since an etching rate of Cu in the mixed aqueous solution of phosphoric acid, acetic acid and nitric acid is sufficiently fast compared to an etching rate of the Al—Nd alloy film, it is possible to selectively etch only the Cu film of the metal-film intermediate layer MML. Also in forming the five-layered film using Mo, since etching rates of Mo and Cu are sufficiently fast compared to the etching rate of the Al—Nd alloy film, it is possible to selectively etch only the three-layered stacked film formed of the Mo films and the Cu film. In etching the Cu film, an ammonium persulfate aqueous solution and a sodium persulfate aqueous solution are effectively used besides the above-mentioned aqueous solution.

Subsequently, due to the patterning of resist by screen printing and etching, the metal-film lower layer MDL is formed in a stripe shape which intersects the lower electrodes DED. The etching is performed by wet etching using a mixed aqueous solution of phosphoric acid and acetic acid. Here, by shifting the printing resist film from the position of the stripe electrodes of the metal-film upper layer MAL, one-side end portion EG1 of the metal-film lower layer MDL is allowed to project from the metal-film upper layer MAL thus forming a contact portion which ensures the connection with the upper electrode AED in a later step. Further, to another-side end portion EG2 opposite to one-side end portion EG1 of the metal-film lower layer MDL, over-etching is performed using the metal-film upper layer MAL and the metal-film intermediate layer MML as a mark and a retracted portion is formed such that an eaves is formed on the metal-film intermediate layer MML.

Using the eaves of the metal-film intermediate layer MML, the upper electrode AED formed in the later stage is separated. Here, since a thickness of the metal-film upper layer MAL is larger than a thickness of the metal-film lower layer MDL, even when the etching of the metal-film lower layer MDL is finished, it is possible to leave the metal-film upper layer MAL on the Cu film of the metal-film intermediate layer MML. Accordingly, it is possible to protect the surface of the Cu film. Accordingly, even when Cu is used, it is possible to ensure the oxidation resistance, the upper electrode AED can be separated in a self-aligning manner, and it is possible to form the upper bus electrode which constitutes the scanning signal line which performs the supply of an electric current. Further, with respect to the five-layered metal-film intermediate layer MML which sandwiches the Cu film with molybdenum films, even when the Al alloy film of the metal-film upper layer MAL is thin, Mo suppresses the oxidation of Cu and hence, it is not always necessary to set the film thickness of the metal-film upper layer MAL larger than the film thickness of the metal-film lower layer MDL.

Subsequently, the interlayer film INS3 is formed to open an electron emitting portion. The electron emitting portion is formed in a portion of an intersecting portion of a space which is sandwiched between one lower electrode DED in the inside of the pixel and two upper bus electrodes (the stacked film formed of the metal-film lower layer MDL, the metal-film intermediate layer MML and the metal-film upper layer MAL and the stacked film formed of the metal-film lower layer MDL, the metal-film intermediate layer MML and the metal-film upper layer MAL of the neighboring pixel not shown in the drawing) which intersect the lower electrode DED. The etching can be performed by dry etching which uses an etchant gas containing $CF_4$ and $SF_6$, for example, as main components.

Finally, the upper electrode AED is formed as a film. In forming the upper electrode AED, a sputtering method is used. As the upper electrode AED, a stacked film formed of, for example, an iridium (Ir) film, a platinum (Pt) film and a gold (Au) film is used, wherein a film thickness is set to 6 nm. Here, in the upper electrode AED, one end portion (the right side in FIG. 5C) of the upper bus electrode (the stacked film formed of the metal-film lower layer MDL, the metal-film intermediate layer MML, the metal-film upper layer MAL) is cut at the retracting portion (EG2) of the metal-film lower layer MDL formed by the eaves structure of the metal-film intermediate layer MML and the metal-film upper layer MAL. Then, at another end portion (the left side in FIG. 5C) of the upper bus electrode, the upper electrode AED is continuously formed with the upper bus electrode (the stacked film formed of the metal-film lower layer MDL, the metal-film intermediate layer MML, the metal-film upper layer MAL) byway of the contact portion (EG1) of the metal-film lower layer MDL without breaking thus allowing the supply of electric current to the electron emitting portion.

Figure 6:
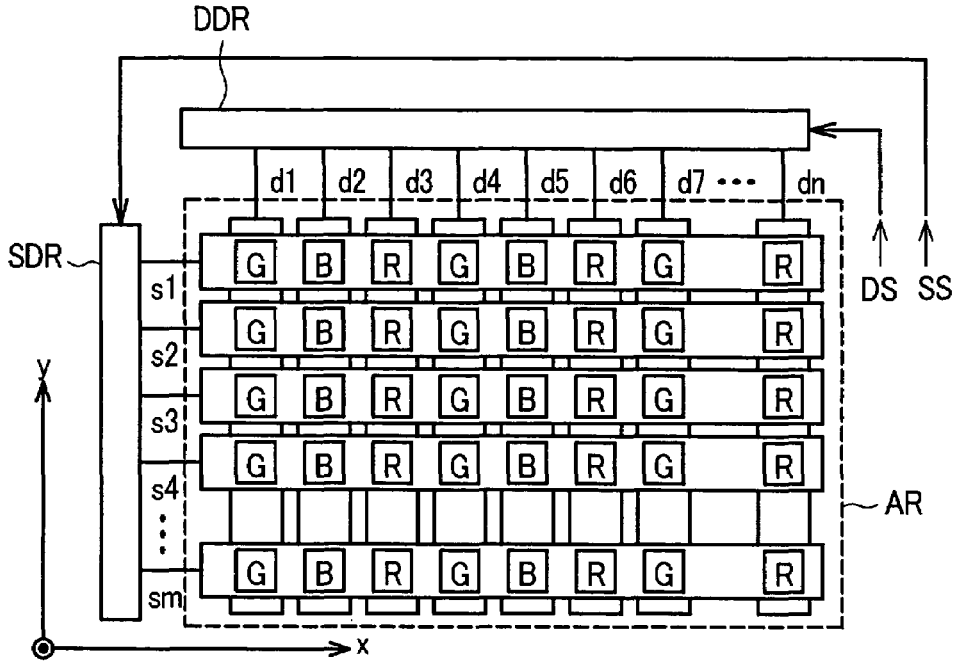
FIG. 6 is an explanatory view of an example of an equivalent circuit of an image display device to which the constitution of the present invention is applied.

FIG. 6 is an explanatory view of an example of an equivalent circuit of the image display device to which the constitution of the present invention is applied.

A region depicted by a broken line in FIG. 6 indicates a display region AR. In the display region AR, the image signal lines d (d1, d2, d3, d4, d5, d6, d7, . . . dn) and the scanning signal lines s (s1, s2, s3, s4, . . . sm) are arranged in a state that these lines intersect each other thus forming pixels which are arranged in a matrix array of n×m. Sub pixels are formed on the respective intersecting portions of the matrix and one group consisting of "R", "G", "B" in the drawing constitutes one color pixel. Here, the constitution of the electron sources is omitted. The image signal lines dare connected to the image signal line driving circuit DDR, while the scanning signal lines s are connected to the scanning signal line driving circuit SDR. The image signal DS is inputted to the image signal line driving circuit DDR from an external signal source, while the scanning signal SS is inputted to the scanning signal line driving circuit SDR in the same manner.

Due to a such constitution, by supplying the image signals to the sub pixels which are connected to the scanning signal lines s which are sequentially selected from the image signal lines d, it is possible to display a two-dimensional full color image. According to the display device of this constitutional example, a flat-panel-type display device which is operated at a relatively low voltage with high efficiency can be realized.

Figure 7:
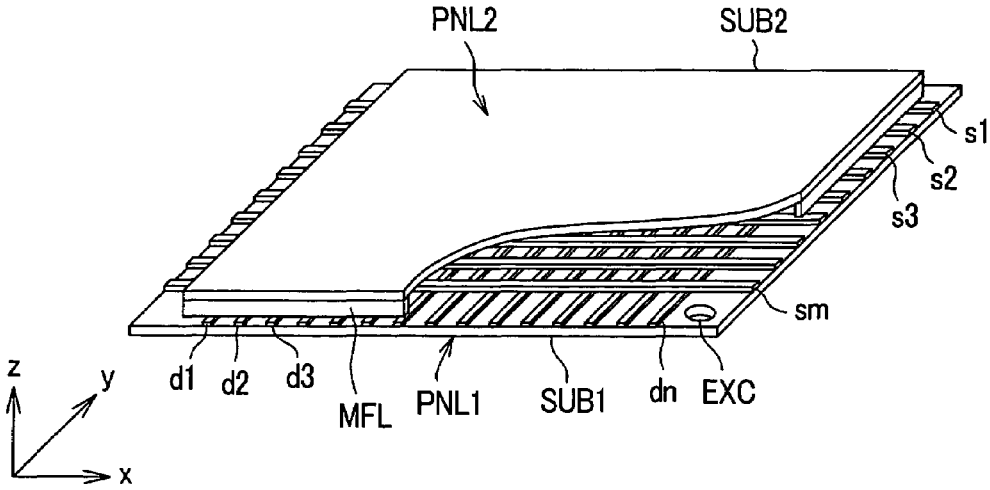
FIG. 7 is a perspective view showing the entire structure of the display panel constituting a flat-panel-type image display device.
Figure 8:
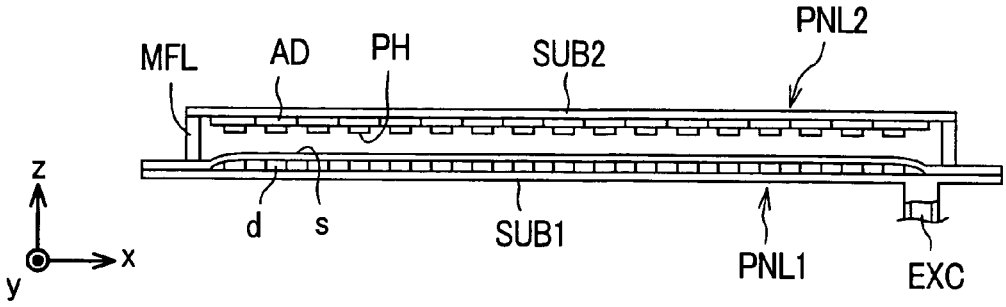
FIG. 8 is a cross-sectional view of FIG. 7.
Figure 9:
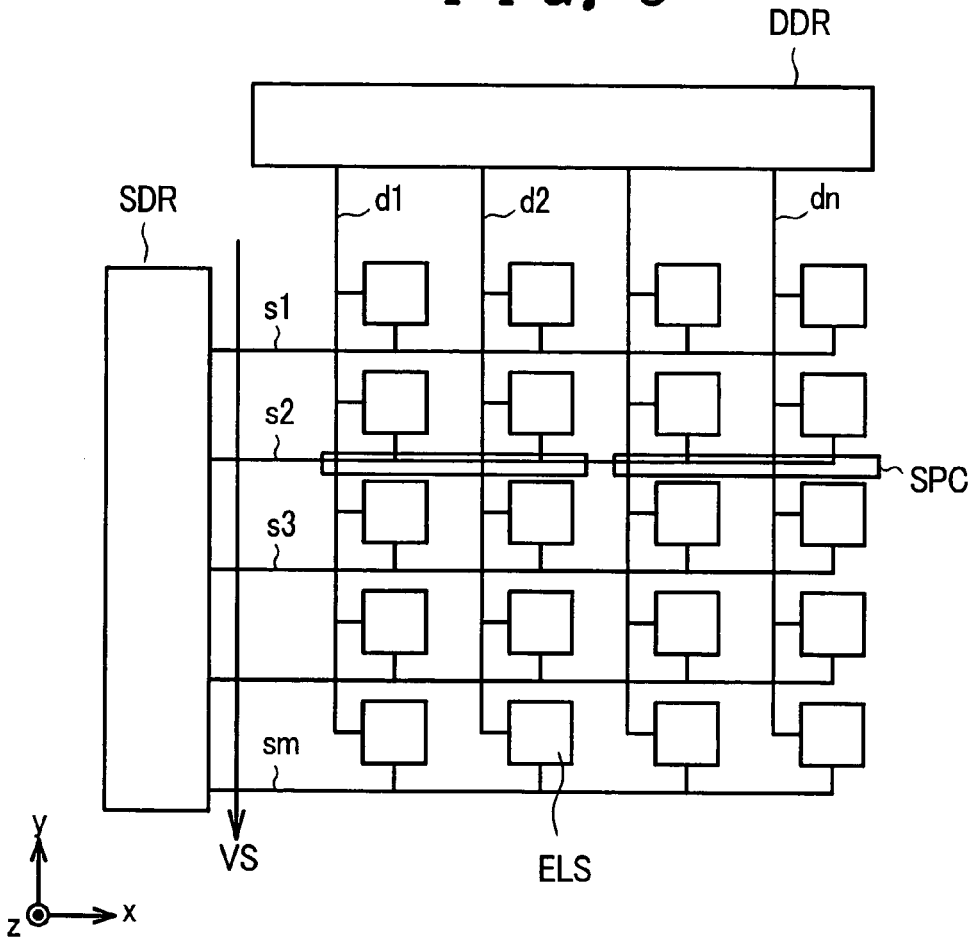
FIG. 9 is a schematic view showing the constitution of the back panel of the self-luminous-type FPD.
Figure 10:
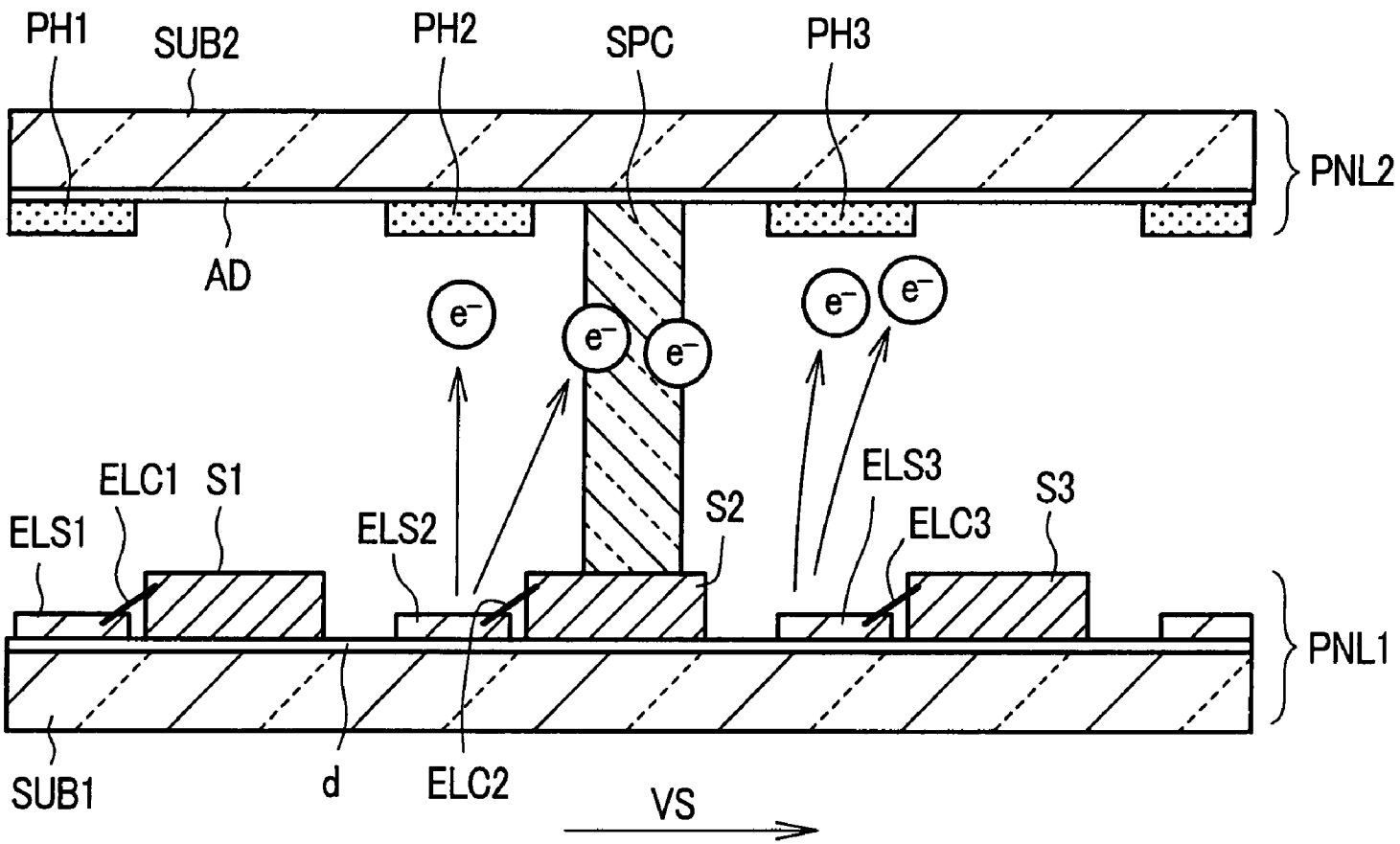
FIG. 10 is a view taken along the y direction in FIG. 9 for explaining an erected state of a partition wall and the behavior of electrons emitted from electron sources.

FIG. 7 is a perspective view showing the entire structure of the display panel which constitutes the flat-panel-type image display device, and FIG. 8 shows the cross section of the image display device. The back panel PNL1 has, as has been explained in the above-mentioned embodiment, the electron source structure which is constituted of the matrix formed of the image signal lines d1, d2, d3, . . . dn and the scanning signal lines s1, s2, s3, . . . sm. On the other hand, the face panel pNL2 uses a transparent glass substrate as the face substrate SUB2 and the anode AD and the phosphor layers PH are formed on the inner surface thereof as films. An aluminum layer is used as the anode AD.

The face panel PNL2 and the back panel PNL1 are arranged to face each other and, for ensuring a given distance between facing surfaces of the face panel PNL2 and the back panel PNL1, the rib-like partition walls SPC having a width of approximately 80 μm and a height of approximately 2.5 mm are fixed onto the scanning signal lines along the extending direction of the scanning signal lines while interposing frit glass therebetween. Here, a sealing frame MFL made of glass is arranged on peripheral portions of both panels and both panels and the sealing frame are fixed to each other using frit glass not shown in the drawing so as to provide the structure in which an inner space sandwiched by both panels is isolated from the outside.

In fixing the partition walls using the frit glass, the structure was heated at a temperature of approximately 400° C. Thereafter, the inside of the device is evacuated to approximately 1 μPa through an exhaust pipe EXC and, thereafter, the exhaust pipe EXC is sealed. In operating the image display device, a voltage of approximately 10 kV is applied to the anode AD on the face panel PNL2.

In the above-mentioned embodiment, although the explanation has been made with respect to the structural example which uses the MIM-type electron source as the electron sources, the present invention is not limited to such an electron source and the present invention is applicable to the self-luminous-type FPD which uses any one of the above-mentioned various electron sources in the same manner.

What is claimed is:

1. An image display device constituted of a display panel comprising a back panel, a face panel, and a sealing frame which is interposed between peripheries of the back panel and the face panel and seals an inner space in which the back panel and the face panel faces to each other in an opposed manner with a given distance therebetween in a given vacuum state, wherein the back panel includes a back substrate on which a plurality of scanning signal lines which extend in one direction and are arranged in parallel in another direction which is orthogonal to one direction and to which scanning signals are sequentially applied in the another direction, a plurality of image signal lines which extend in the another direction and are arranged in parallel in one direction so as to intersect the scanning signal lines, electron sources which are formed in the vicinities of respective intersecting portions of the scanning signal lines and the image signal lines, and current supply electrodes which are connected to the scanning signal lines so as to supply an electric current to the electron sources are formed, the face panel includes a face substrate on which phosphor layers which are formed corresponding to the electron sources respectively, and an acceleration electrode which accelerates electrons emitted from the electron sources so as to direct the electrons to the phosphor layers in response to a potential difference between the current supply electrodes and the image signal lines are formed, partition walls which hold the distance between the back panel and the face panel are formed on some scanning signal lines along the extending direction of the scanning signal lines, and the current supply electrodes are connected with the electron sources on a downstream side of the scanning signal lines.

2. An image display device according to claim 1, wherein the electron source includes a lower electrode, an upper electrode, and an electron accelerating layer which is sandwiched between the lower electrode and the upper electrode, and constitutes a thin-film-type electron emitting element which emits electrons from the upper electrode by applying a voltage between the lower electrode and the upper electrode.

3. An image display device according to claim 1, wherein plural partition walls which are separated from one another are arranged on a same scanning signal line.

4. An image display device according to claim 1, wherein the phosphors layers formed on the face panel are constituted of phosphors having three colors consisting of red, green and blue.

5. An image display device according to claim 4, wherein the respective phosphor layers are defined by a light blocking layer.

6. An image display device according to claim 1, wherein the distance between a respective partition wall and a closest adjacent electron source is smaller on the downstream side of said partition wall than on the upstream side of said partition wall.

7. An image display device according to claim 6, wherein a plurality of electron sources are arranged on the downstream and upstream sides of a respective partition wall and have a same distance between adjacent electron sources on the downstream and upstream sides.

* * * * *